US007284755B1

(12) United States Patent
Bolen

(10) Patent No.: US 7,284,755 B1
(45) Date of Patent: Oct. 23, 2007

(54) BULK VENDING MACHINE HAVING AN INTEGRATED GAME OF SKILL

(76) Inventor: Richard K. Bolen, 4000 Clubhouse Dr., Champaign, IL (US) 61822

( * ) Notice: Subject to any disclaimer, the term of this patent is extended or adjusted under 35 U.S.C. 154(b) by 0 days.

(21) Appl. No.: 11/392,421

(22) Filed: Mar. 29, 2006

(51) Int. Cl.
*A63F 7/00* (2006.01)

(52) U.S. Cl. ..... 273/109; 273/118 R; 273/119 R; 273/113; 273/123 R

(58) Field of Classification Search ..... 273/108, 273/109, 113, 118 R, 118 A, 119 R, 119 A, 273/121 R, 121 A, 122 R, 122 A, 123 R, 273/123 A, 124 R, 124 A, 125 R, 125 A; 194/350
See application file for complete search history.

(56) References Cited

U.S. PATENT DOCUMENTS 1,700,541 A * 1/1929 Mills ..... 221/200
2,003,349 A * 6/1935 Dumble ..... 194/210
3,476,391 A * 11/1969 Fejko ..... 273/124 R
5,722,656 A * 3/1998 Dickerson ..... 273/118 R
5,988,637 A * 11/1999 Dickerson ..... 273/118 R
6,062,560 A * 5/2000 Peterson ..... 273/118 R
6,209,868 B1 * 4/2001 Norton ..... 273/118 R
D448,050 S * 9/2001 Humphrey ..... D20/7
6,398,216 B1 * 6/2002 Humphrey ..... 273/118 R
6,497,407 B2 * 12/2002 Humphrey ..... 273/118 R
6,598,876 B1 * 7/2003 Pierce et al. ..... 273/118 R
6,695,698 B1 * 2/2004 Anghelo et al. ..... 463/25

* cited by examiner

*Primary Examiner*—Raleigh W. Chiu
(74) *Attorney, Agent, or Firm*—Brinks Hofer Gilson & Lione

(57) ABSTRACT

A bulk vending machine having an integrated game of skill includes a base having a chute door and a coin mechanism operatively attached thereto. The bulk vending machine further includes a hopper in which the bulk product is contained, and the hopper is operatively connected to both the coin mechanism and the chute door. The game of skill is connected to the bulk vending machine such that the game of skill is movable relative to the frame of the bulk vending machine. The game of skill includes a playing field in which a game piece is maneuvered in order to satisfy objectives of the game of skill, whereby the consumer may win a prize by completing the objectives of the game.

21 Claims, 5 Drawing Sheets

BULK VENDING MACHINE HAVING AN INTEGRATED GAME OF SKILL

TECHNICAL FIELD

This invention relates to bulk vending machines, and more particularly, to a bulk vending machine having an integrated game of skill.

BACKGROUND

Bulk vending machines occupy a special and important position not just because of the sales generated therefrom but because of the unique niche that these machines possess in the minds of the public. The bulk vending machine has endured and thrived as a fixture of the retail environment. At least one bulk vending machine and more likely several, can be found in the entrance way or lobby of nearly every supermarket, department store, hardware store, gas station and restaurant in the United States. The proceeds of the bulk vending machine may augment the income of the proprietor of the premises where it is located or may be collected by an independent operator, which may be a charitable organization.

Coin operated bulk vending machines of the type used to vend candy, nuts, capsules containing articles, stickers, gum, and the like are commonplace. Conventional bulk vending machines comprise two primary operational segments, a product storage area, or hopper, and a base. The product storage area is typically disposed atop the base. The base contains a coin mechanism and at least one coin slot for receiving selected coinage. The base also includes a chute door through which the vended goods are dispensed to the consumer. While gravity provides the predominant force utilized in dispensing the product from bulk vending machines, mechanical force must be generated to move the product from the product storage area to the chute door. Typically, such actuating force is provided by a crank handle linked through selected gearing to a rotatable, segmented merchandise wheel located adjacent to, or within, the product storage area.

In operation, after the appropriate, authorized coinage is placed in the coin slot(s) of the coin mechanism, the manual crank handle is rotated one complete rotation by the consumer. As the crank handle is turned, it imparts an amount of incremental rotation, which is determined by the gearing, to the merchandise wheel disposed within the product storage area to cause the dispensation of at least one piece of the product to the chute door. Bulk vending machines require no electrical assistance in order to dispense a product to the consumer.

A special aspect of the bulk vending machine is that it relies almost exclusively on point-of-sale appeal. As such, it should be attractive and alluring to potential customers. Attractive machines tend to catch the attention of the consumer such that the consumer approaches a rack of machines, or a plurality of machines aligned next to each other, and may purchase a product from the machine which attracted the consumer or a machine adjacent to the machine that attracted the consumer to the rack of machines. On the other hand, if the bulk vending machine is too garish or noticeable, it might offend the aesthetics or sensibilities of some members of the public, including the proprietor of the premises upon which it is located, and become unwelcome. Designers and marketers of bulk vending machines must balance these conflicting criteria. Several methods of making bulk vending machines more appealing to the consumer are used. However, in todays hands-on, need for visually stimulation advertising environment, there is a need to provide the consumer with an interactive manner of dispensing product from a bulk vending machine.

Accordingly, it is an object of the present invention to provide an interactive, entertaining way of utilizing a bulk vending machine to dispense a product to the consumer.

BRIEF SUMMARY

The present invention solves one or more of the shortcomings presented above by providing a game of skill integrated with a bulk vending machine. The game of skill attracts potential consumers to the bulk vending machine and provides the consumer with an interactive manner of dispensing a product from a bulk vending machine.

In one aspect, a bulk vending machine is provided. The bulk vending machine includes a base having a coin mechanism operatively connected to the base and a chute door also operatively connected to the base. The bulk vending machine also includes a hopper that is operatively connected to both the coin mechanism and the chute door. A frame connects the hopper and the base, extending therebetween. The bulk vending machine further includes a game of skill connected to the frame.

In another aspect, a game of skill integrated with a bulk vending machine is provided. The game of skill includes a game piece that is maneuverable within a playing field. The playing field includes at least one obstacle, at least one entrance aperture, and at least one exit aperture. The playing field is connected to the bulk vending machine by a connecting mechanism. The playing field is movable relative to the bulk vending machine.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION OF THE DRAWINGS AND THE PRESENTLY PREFERRED EMBODIMENTS

Bulk vending machines are adapted to vend a variety of merchandise. The merchandise, or product, dispensed from a bulk vending machine may include gumballs, high-bounce balls, candy, gum, toys, novelty stickers, temporary tattoos, trading cards, or capsules. Bulk vending machines come in a variety of shapes and sizes, but bulk vending machines are different from other types of vending machines because there is no electricity required to complete the dispensation of the product. Bulk vending machines are completely controlled by the consumer. Once money is put in the bulk vending machine, a mechanism must be turned in order to dispense the product. If the consumer does not rotate the mechanism completely, the money stays in the mechanism until it is fully turned. Other types of vending machines require electrical assistance to vend a product.

Figure 1:
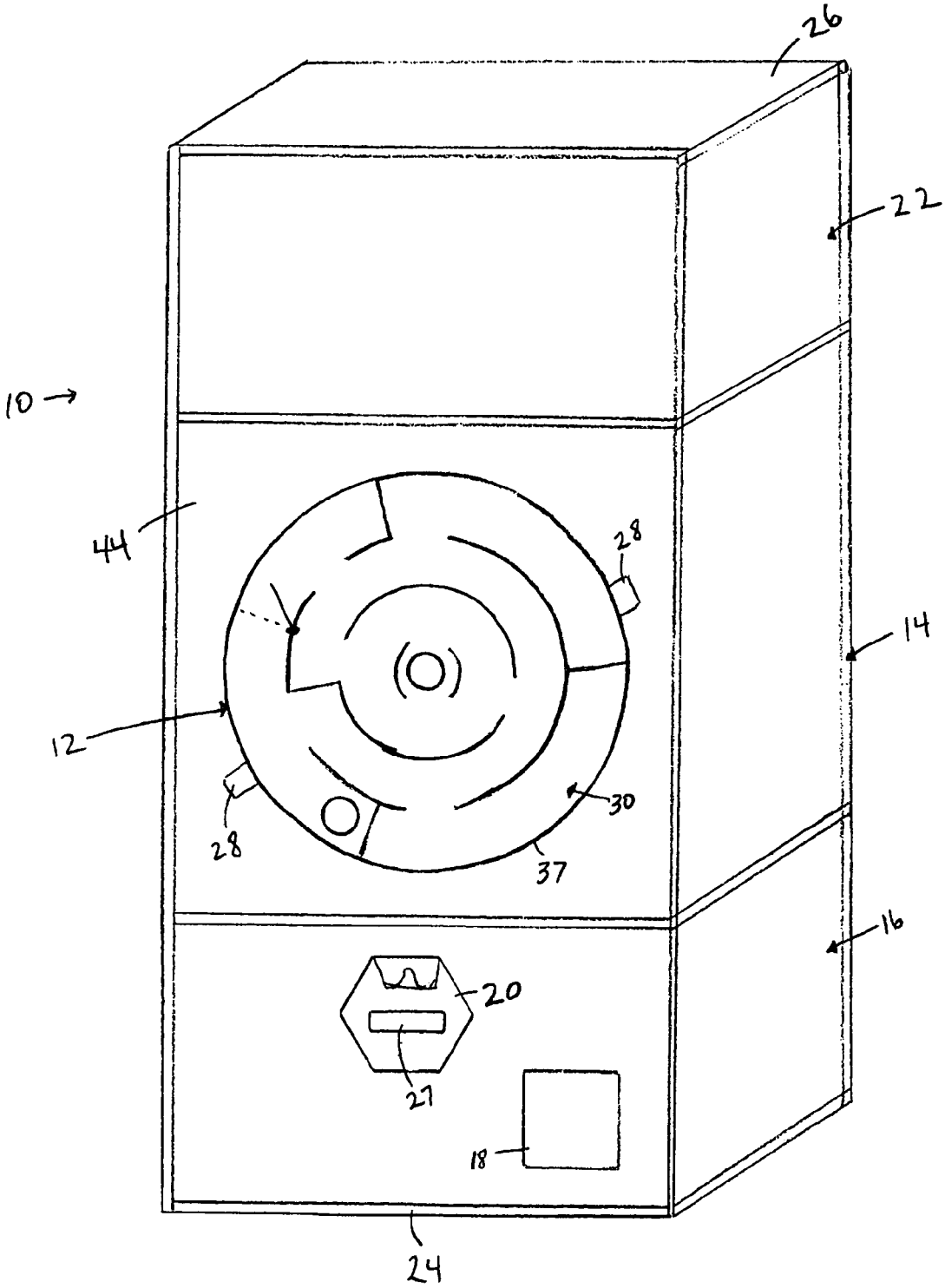
FIG. 1 is a top perspective view of a first embodiment of a bulk vending machine including a game of skill.

Referring to FIG. 1, one embodiment of a bulk vending machine 10 with an integrated game of skill 12 is shown. The bulk vending machine 10 includes conventional components including, but not limited to, a frame 14, a base 16, a chute door 18, a coin mechanism 20, and a product storage area, or hopper 22. The frame 14 extends between a tray 24 a lid 26. The chute door 18 and coin mechanism 20 can be operatively connected to the base 16. The hopper 22 contains the bulk product being dispensed in the transaction with the consumer. The hopper 22 is enclosed within the frame 14 and disposed above the base 16. In one embodiment, the hopper 22 is spaced apart from the base 16. In an alternative embodiment (not shown), the hopper 22 is disposed immediately adjacent to the base 16.

The coin mechanism 20 is adapted to receive at least one coin from a consumer. The coin mechanism 20 includes a rotatable handle 27 that is operatively connected to a merchandise wheel (not shown) disposed within, or adjacent to, the hopper 22. The coin mechanism 20 is operatively connected to the merchandise wheel such that rotation of the coin mechanism 20 results in the rotation of the merchandise wheel. The merchandise wheel includes segmented portions to which the product located within the hopper 22 is fed by gravity. The rotation of the merchandise wheel then dispenses at least one piece of the product. The bulk vending machine 10 can be configured such that the product wheel dispenses at least one piece of product directly to the chute door 18 in the base 16, directly to a game of skill 12, or a combination thereof. Examples of a coin mechanism 20 are explained in U.S. Pat. Nos. 6,079,540 and 5,509,521, and an example of a merchandise wheel is explained in U.S. Pat. No. 6,182,859, the entire disclosures of which are incorporated herein by reference.

Figure 2:
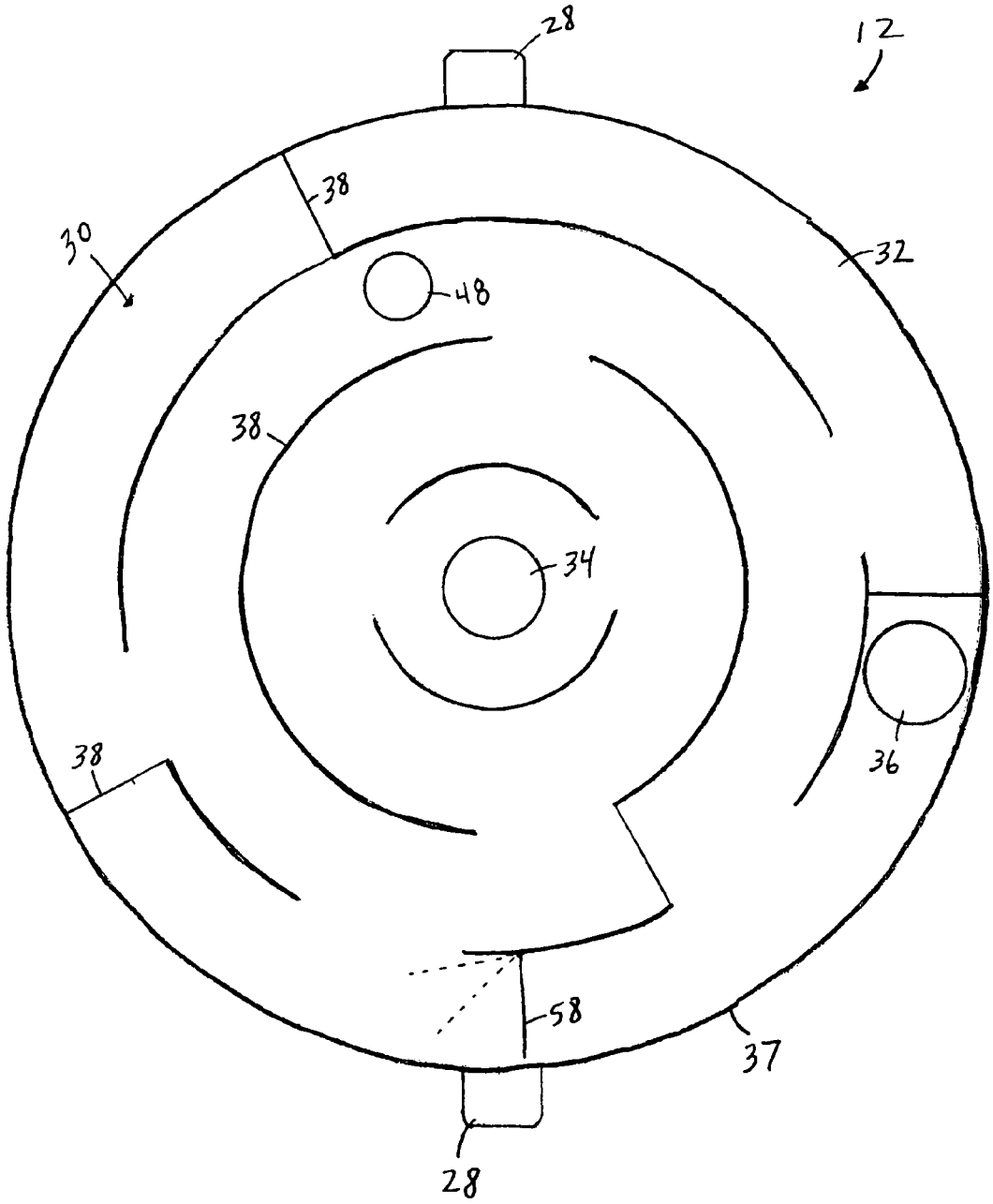
FIG. 2 is a front view of a first embodiment of a game of skill.

A game of skill 12 is integrated with the bulk vending machine 10, as illustrated in FIG. 1, so as to provide a user with an entertaining game as well as to attract potential consumers to the bulk vending machine 10. A game of skill 12 can be any type of game that involves the manipulation of a game piece within a playing field by a consumer in order to satisfy defined objectives of the game. One exemplary embodiment of a game of skill 12, illustrated in FIG. 2, is in the form of a maze. The game of skill 12 includes at least one control mechanism 28, playing field 30, a floor 32, an entrance aperture 34, at least one exit aperture 36, and at least one obstacle 38. A side wall 37 extends from the floor 32 such that the playing field 30 is defined above the floor 32 and within the side wall 37. In one embodiment, the side wall 37 is attached to the floor 32. In another embodiment, the floor 32 and side wall 37 are formed as a single member. The playing field 30 is enclosed by a cover 39 (FIG. 4) that is disposed immediately adjacent to the side wall 37 in an abutting manner and is adapted to cover at least the entire area bounded by the side wall 37, thereby preventing a game piece 48 from exiting the playing field 30 except through an aperture 34, 36 formed in the floor 32.

Figure 3:
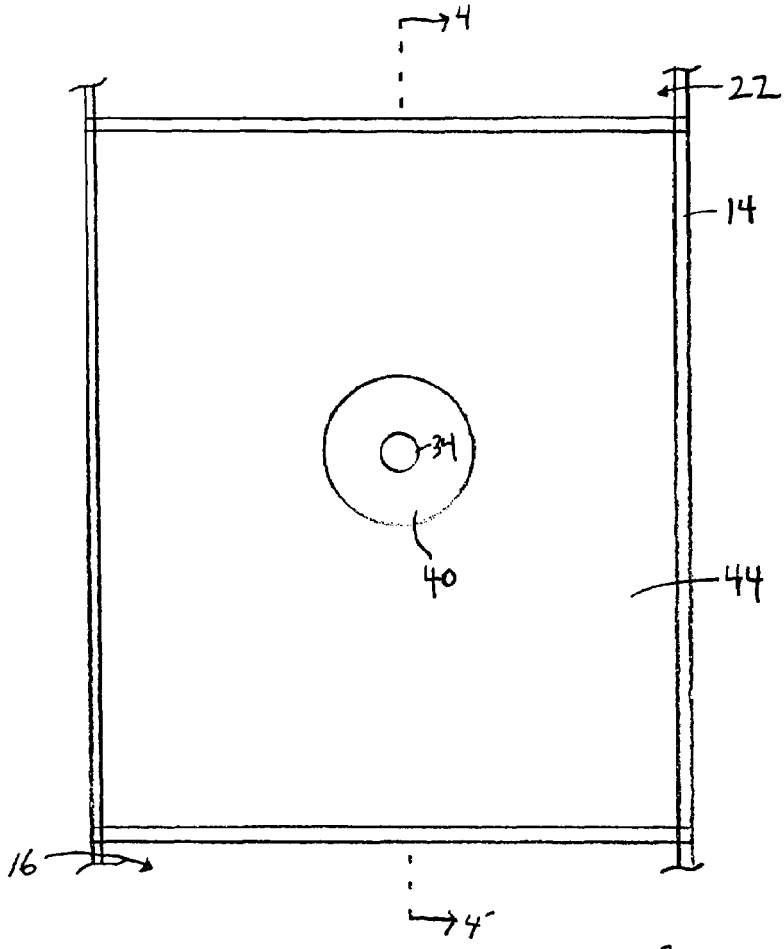
FIG. 3 is a truncated front view of the bulk vending machine of FIG. 1 with the game of skill removed.
Figure 4:
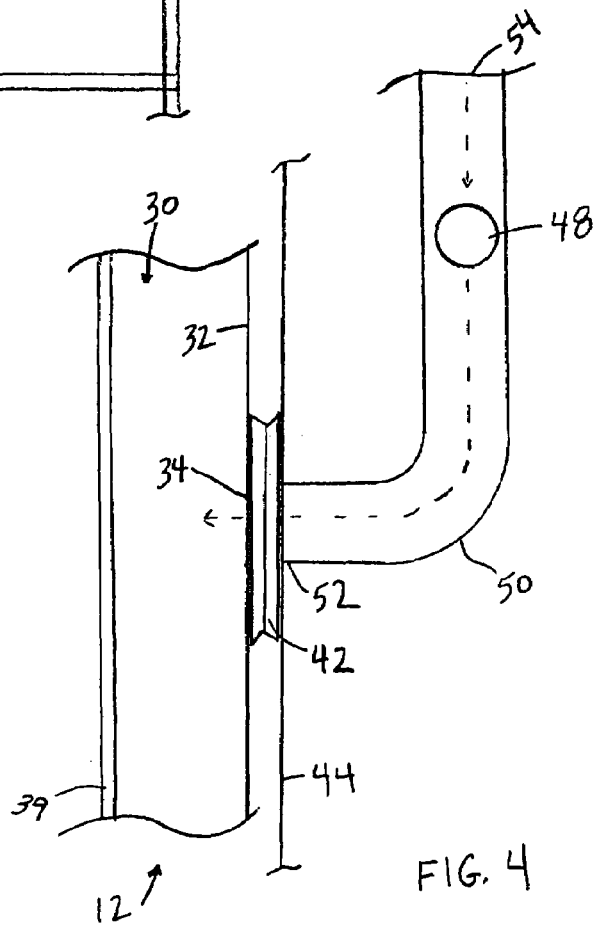
FIG. 4 is a magnified side view of one embodiment of a connecting mechanism between a bulk vending machine and a game of skill.

The game of skill 12 is operatively attached to a structural member, in this case a flat panel member 44, extending between opposing members of the frame 14, as illustrated in FIGS. 3-4, thereby allowing the game of skill 12 to be movable relative to the panel member 44 and the frame 14. Exemplary ways in which the game of skill is movable include, but are not limited to, being rotatable, translatable, titlable, or any combination thereof. A connecting mechanism 40 provides an operative connection between the game of skill 12 and the panel member 44. In one embodiment, the connecting mechanism 40 can be a rotatable bearing 42 that is attached to the rear surface of the floor 32 of the game of skill 12 as well as to the panel member 44, as shown in FIG. 4, thereby allowing the game of skill 12 to be movable relative to the panel member 44. In an alternative embodiment, the connecting mechanism 40 can be a series of elongated tracks (not shown) formed in the panel member 44, wherein the tracks are adapted to receive at least one pin extending from the floor 32 of the game of skill 12 that allows the game of skill 12 to be translatable and rotatable relative to the panel member 44. The connecting mechanism 40 can be any conventional mechanism that allows the game of skill 12 to be movable relative to frame 14 of the bulk vending machine 10. In an alternative embodiment, the game of skill 12 is fixedly attached to the panel member 44, but the obstacles 38 in the playing field 30 are movable relative to the floor 32 and side wall 37 of the game of skill 12.

The coin mechanism 20, illustrated in FIG. 1, is operatively connected to a merchandise wheel (not shown) that is located adjacent to the hopper 22, whereby rotation of the coin mechanism 20 causes the merchandise wheel to dispense at least one piece of the product contained in the hopper 22. In one embodiment, when the coin mechanism 20 is rotated by the consumer after insertion of proper coinage into the coin slot, at least one piece of the product is transferred directly to the chute door 18 for retrieval by the consumer. In one embodiment, the game of skill 12 integrated with the bulk vending machine 10 is self-contained such that a consumer can play the game of skill 12 without the need to provide coinage to dispense a piece of product. The playing field 30 includes a game piece 48 disposed therein such that a consumer can manipulate the game of skill 12, and successful completion of the game of skill 12 causes the game piece 48 to be re-inserted into the playing field 30. The game of skill 12 will not be restarted unless the game of skill is successfully completed. Actions relating to the dispensation of the piece of product are independent of the ability for a consumer to participate in the game of skill 12.

In another embodiment, when the coin mechanism 20 is rotated by the consumer after insertion of proper coinage, at least one piece of product is transferred directly to the game of skill 12 from the hopper 22, whereby the consumer must successfully complete the game of skill 12 in order to retrieve the product. The successful completion of the game of skill 12 can involve either a win or a loss. A consumer wins the game of skill 12 when the objectives of the game of skill 12 are accomplished, and a consumer loses the game of skill 12 when the consumer is unable to accomplish the objectives of the game of skill 12. The game of skill 12 can be configured such that only a win will allow the piece of product to be transferred to the chute door 18 for retrieval by the consumer, or the game of skill 12 can be configured such that either a win or a loss will allow the product to be transferred to the chute door 18 for retrieval by the consumer. The piece of product utilized as the game piece in the game of skill 12 is the piece of product dispensed to the consumer upon completion of the game of skill 12.

In yet another embodiment, when the coin mechanism 20 is rotated by the consumer after insertion of proper coinage, at least one piece of the product (not shown) is transferred directly to the chute door 18 to be retrieved by the consumer and another piece of the product is simultaneously transferred to the game of skill 12 to be potentially won as a prize for the successful completion of the game of skill 12. The piece of product being dispensed to the game of skill 12 acts as a game piece 48 to be manipulated within the playing field 30. Once the piece of product has been transferred to the playing field 30, the consumer has the opportunity to complete the game of skill 12 utilizing the piece of product. In one embodiment, if the consumer is able to win the game of skill 12 by accomplishing the objectives of the game of skill 12, the piece of product that was transferred to the playing field 30 is then transferred to the chute door 18 for retrieval by the consumer such that the consumer receives at least one piece of product in exchange for the proper coinage as well as the additional piece of product as a reward for winning the game of skill 12. If the consumer loses the game of skill, whereby the objectives of the game of skill are not satisfied, the piece of product that was transferred to the playing field is not then transferred to the chute door 18. As an alternative, at least one piece of the product is dispensed in exchange for the proper coinage and another piece of the product is transferred to the playing field, and regardless of winning or losing the game of skill the additional piece of the product is transferred to the chute door 18 to be retrieved by the consumer.

In still a further embodiment, when the coin mechanism 20 is rotated by the consumer after insertion of proper coinage, at least one piece of the product is transferred directly to the chute door 18 to be retrieved by the consumer and a game piece 48 is simultaneously inserted into the playing field 30 of the game of skill 12 from a game piece storage location (not shown). The game piece 48 is separate from the product being dispensed and is not transferred to the chute door 18 for retrieval by the consumer. Instead, once the consumer manipulates the game of skill 12 such that the game piece 48 exits the playing field 30 by either a win or a loss, the game piece 48 is returned to the game piece storage location to be used for subsequent insertions into the playing field 30. The exit of the game piece 48 from the playing field 30 can cause at least another piece of the product to be dispensed to the chute door 18 as a result of successful completion of the game of skill 12 or at least another piece of the product to be dispensed to the chute door 18 regardless of a win or a loss in the game of skill 12.

The game piece 48 enters the playing field 30 of the game of skill 12 by way of an entrance aperture 34, as illustrated in FIGS. 2-4. The game piece 48 can be any object sufficient to be used for manipulation within the playing field 30 including, but not limited to, a piece of the product contained in the hopper 22, a high-bounce ball, a gumball, a metal ball, a marble, or a jawbreaker. In one embodiment, as shown in FIGS. 3-4, an entrance aperture 34 extends through the panel member 44, the connecting mechanism 40, and the floor 32, whereby the game piece 48 enters the playing field 30 at centrally-located position. In another embodiment, at least one entrance aperture 34 is formed through the floor 32 and is adjacent to or spaced-apart from the connecting mechanism 40. At least one entrance aperture 34 is formed through the floor 32 of the playing field 30 so as to allow a game piece 48 to be inserted into the playing field 30. Multiple entrance apertures 34 can be formed through the floor 32 of the playing field 30, thereby allowing multiple game pieces 48 to enter the playing field 30 or allowing a single game piece 48 to enter the playing field 30 at one of multiple entrance apertures 34 formed through the floor 32.

The game piece 48 can be transferred to the playing field by way of a tube 50, as illustrated in FIG. 4. The tube 50 is of sufficient size to allow a variety of different types of game pieces 48 to be transferred through the tube 50 to the playing field 30. The tube 50 can have any cross-sectional shape sufficient to receive and allow the transfer of a variety of different types of game pieces 48. The tube 50 is operatively attached to the panel member 44 whereby the opening at the first distal end 52 of the tube 50 is aligned with an entrance aperture 34 formed in the floor 32 of the game of skill 12. In the embodiment shown in FIG. 4, the tube 50 is aligned with the entrance aperture 34 formed through the rotatable bearing 42 and the floor 32 of the playing field 30 such that the game piece 48 is dispensed at a central location within the playing field 30. Such a direct connection allows for the game piece 48 to be inserted into the playing field 30 at the same location for each attempt at the game of skill 12. In another embodiment, the tube 50 provides an indirect insertion of the game piece 48 into the playing field 30. The opening at the first distal end 52 of the tube 50 is secured to an aperture (not shown) formed in the panel member 44, wherein the tube 50 extends from the panel member 44 at an angle such that the weight of the game piece 48 causes the game piece 48 to be directed through the aperture in the panel member 44 and against the rear surface of the floor 32 of the game of skill 12. The floor 32 of the playing field 30 has at least one entrance aperture 34 alignable with the aperture in the panel member 44 and the opening at the first distal end 52 of the tube 50 such that when the entrance aperture 34 is aligned therewith the game piece enters the playing field 30.

The opposing, second distal end 54 of the tube 50 receives the game piece 48, whereby the game piece 48 is transported through the tube and is inserted into the playing field 30. In one embodiment, the second distal end 54 of the tube 50 is operatively attached to the merchandise wheel (not shown) located adjacent to the hopper 22 such that at least one piece of the product is transported by way of tube 50 to the playing field 30 such that the piece of product dispensed from the merchandise wheel becomes the game piece 48 for the game of skill 12. The merchandise wheel can be configured to deliver a piece of product directly to the game of skill 12, the chute door 18, or both the game of skill 12 and the chute door 18 simultaneously. In another embodiment, the second distal end 54 of the tube 50 is attached to a storage area (not shown) in which game pieces 48 are stored and kept separate from the product being dispensed. Rotation of the coin mechanism 20 containing sufficient coinage for dispensing at least one piece of product also causes at least one game piece 48 to be transferred from the game piece storage area to the playing field 30 of the game of skill 12.

Once the game piece 48 enters the playing field 30, the consumer can move the game of skill 12 relative to the panel member 44 in order to manipulate the game piece within the playing field 30 in order to satisfy the objectives of the game of skill 12. At least one exit aperture 36 is formed through the floor 32 of the playing field 30 so as to allow a game piece 48 to exit the playing field 30. Multiple exit apertures 36 can be formed through the floor 32 of the playing field 30, thereby allowing multiple locations at which a game piece 48 can exit the playing field 30. In one embodiment, the exit aperture 36 is operatively connected to the chute door 18 such that when the game piece 48 leaves the playing field 30, the game piece 48 is transferred to the chute door 18 for retrieval by the consumer. In another embodiment, the exit aperture 36 is operatively connected to the game piece storage area (not shown) such that when the game piece 48 exits the playing field 30 by way of the exit aperture 36, the game piece 48 is transferred to the game piece storage area. The game piece remains in the storage area until being selectively transferred to the playing field 30 again.

The game piece 48 can be maneuvered within the playing field 30 by at least one control mechanism 28 attached to the game of skill 12, as illustrated in FIG. 2. The control mechanism 28 is operatively attached to the game of skill 12 thereby allowing the consumer to move the game of skill 12 relative to the panel member 44 and frame 14 of the bulk vending machine 10. The control mechanism 28 can be a handle, a rotatable knob, a finger grip, or any other mechanism sufficient to allow the consumer to control the movement of the game of skill 12. As illustrated in FIG. 2, a pair of control mechanisms 28 can be formed as handles extending radially outward from the side wall 37 of the playing field 30. It should be understood by one skilled in the art that any control mechanism sufficient to allow the consumer to move the game of skill 12 relative to the panel member 44 can be used.

The playing field 30 is defined between the floor 32, the cover 29, and at least one side wall 39, as shown in FIGS. 2 and 4. The floor 32 has at least one aperture formed therethrough to allow a game piece 48 to pass so as to provide a consumer an opportunity to play the game of skill 12. The cover 39 prevents the game piece 48 from exiting the playing field 30. The side wall 37 extends between the floor 32 and the cover 39, thereby defining a three-dimensional space in which the game of skill 12 is played. The playing field 30 can have a circular, square, rectangular, polygonal, or any other shape and size sufficient to contain at least one obstacle 38 used in the game of skill 12.

The playing field 30 includes at least one obstacle 38 extending at least a portion of the distance between the floor 32 and the cover 39, as shown in FIG. 2. The obstacles 38 are oriented in a substantially perpendicular manner relative to the floor 32 and the cover 39, but can be oriented at any angle relative to the floor 32 and cover 39. In one embodiment, the obstacles 38 can be fixed to the floor 32, the side wall 37, the cover 39, or any combination thereof by a weld. In an alternative embodiment, the floor 32 includes a plurality of slots (not shown) formed therethrough and each obstacle 38 includes a corresponding tab (not shown) that is configured to be received within the slot formed through the floor 32. When assembled, the tabs of the obstacles 38 are inserted into the corresponding slots through the floor 32 and the cover 39 contacts the obstacles 38 in order maintain the obstacles 38 in a substantially pre-defined position relative to the floor 32 and cover 39.

Obstacles 38 located within the playing field 30 can include walls, one-way swinging doors, ramps, bumpers, springs, loops, rails, screens, walls, or any other object that may increase, decrease, or change the overall level of difficulty of the game of skill 12. The obstacles 38 are arranged within the playing field 30 to require the consumer to manipulate or navigate the game piece 48 around, through, over, or under the obstacles 38 within the playing field 30 in order to satisfy at least one objective of the game of skill 12. The tasks for the game of skill 12 can be marked on the floor 32, the cover 39, the side wall 37 or anywhere on the structure of the bulk vending machine 10 so as to provide the consumer with instruction on how to satisfy the objectives of the game of skill 12.

Referring to FIG. 2, a first exemplary embodiment of a game of skill 12 is shown. The game of skill 12 has a circular playing field 30. A pair of control mechanisms 28 extend radially outward from the side wall 37, and the side wall 37 bounds the area defining the playing field 30. The floor 32 has an entrance aperture 34 formed through the axial centerline of the playing field 30 to allow the game piece 48 to enter the playing field, wherein the entrance aperture 34 extends through the connecting mechanism 40 that is in the form of a rotatable bearing, as shown in FIG. 3, to allow the game of skill 12 to be movable relative to the panel member 44 and the frame 14. The floor 32 also has an exit aperture 36 formed therethrough that allows the game piece 48 to leave the playing field 30. The game of skill 12 is configured such that successful completion of the game of skill 12 requires the game piece 48 to be navigated to the exit aperture 36. The game piece 48 is navigated around a plurality of obstacles 38 formed as walls that extend between the floor 32 and the cover 39. Some of the obstacles 38 are concentrically-oriented arced walls that are disposed at a spaced-apart distance from the center of rotation of the playing field 30. Other obstacles 38 include walls that extend radially outward to connect concentrically oriented walls. A one-way swinging door 58 is attached to one of the curved walls in order to increase the difficulty level of the game of skill 12. The game piece 48 is a piece of product that is transferred to the playing field 30 from the hopper 22, and upon navigating the game piece 48 to the exit aperture 36 the game of skill 12 is completed and the game piece 48 is then transferred to the chute door 18 to be retrieved by the consumer as the prize for successful completion of the game of skill 12.

Referring to FIG. 5, a second exemplary embodiment of a game of skill 112 is shown. The game of skill 112 includes a playing field 130 having a floor 132, an entrance aperture 134, at least one exit aperture 136, a side wall 137, a plurality of obstacles 138, and a cover (not shown). The entrance aperture 134 can be located at the center of the playing field 130 to allow at least one game piece to enter the playing field from a location external to the game of skill 112 regardless of the position of the playing field 130 relative to the panel member 44 to which the game of skill 112 is attached. It should be understood by one skilled in the art that the entrance aperture 134 can be formed through the floor 132 at any position within the playing field 130 sufficient to allow a game piece to be insertable into the playing field 130 from a position external to the playing field.

The playing field 130 includes a plurality of obstacles 138 formed as walls 140 that extend between the floor 132 and the cover, thereby forming a maze through which a game piece is to be navigated by the consumer. The playing field 130 further includes a winning exit aperture 142 and a plurality of losing exit apertures 144. The winning exit aperture 142 is formed through the floor 132 and is adapted to receive the game piece when the consumer successfully completes the game of skill 112. The losing exit apertures 144 are formed through the floor 132 and are adapted to receive the game piece when the consumer fails to successfully complete the game of skill 112. One losing exit aperture 144 is located adjacent to a one-way door 146 that allows a game piece to contact the one-way door 146, thereby swinging the door to an open position and allowing the game piece to pass but once the game piece has passed, the one-way door 146 swings to a closed position such that the game piece cannot pass the one-way door 146 in the opposing direction. In FIG. 5, the one-way door 146 allows the game piece to enter a space having a losing exit aperture 144 through which the game piece exits the playing field 130 such that the consumer is unsuccessful in completing the game of skill 112.

Figure 5A:
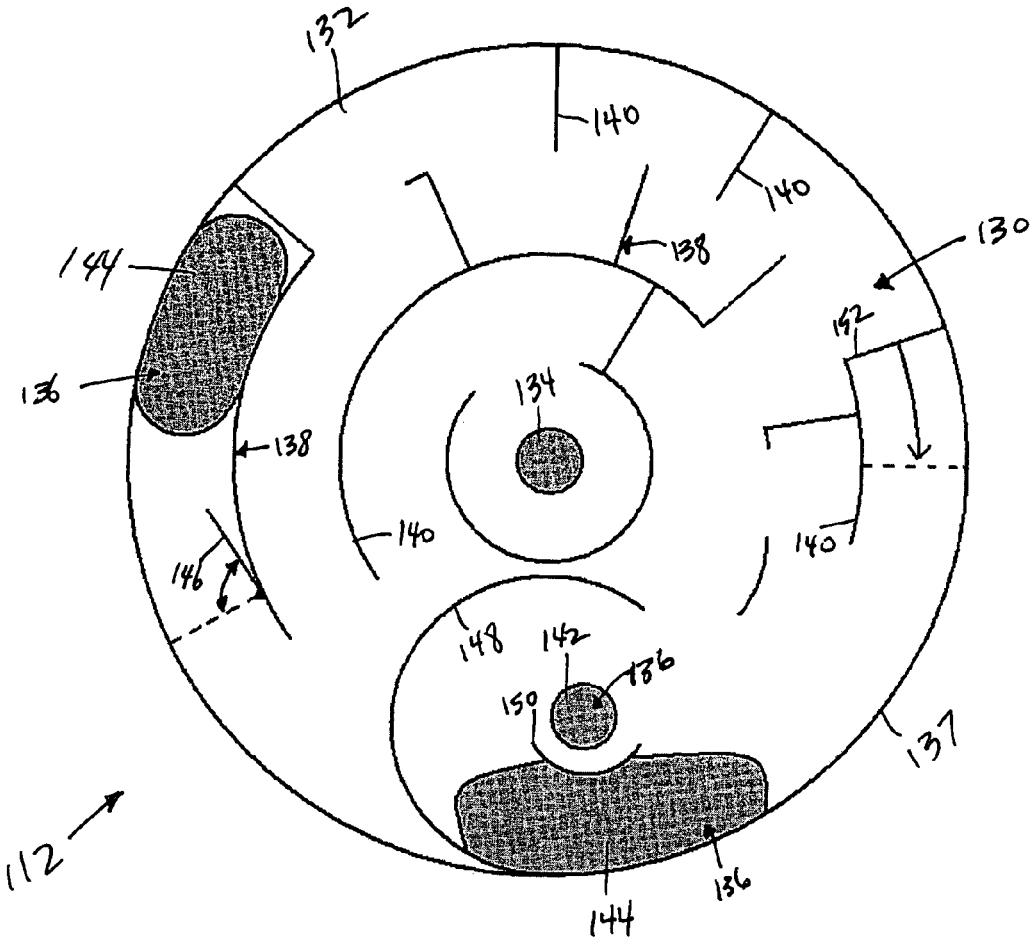
FIG. 5A is a front view of a second embodiment of a game of skill.
Figure 5B:
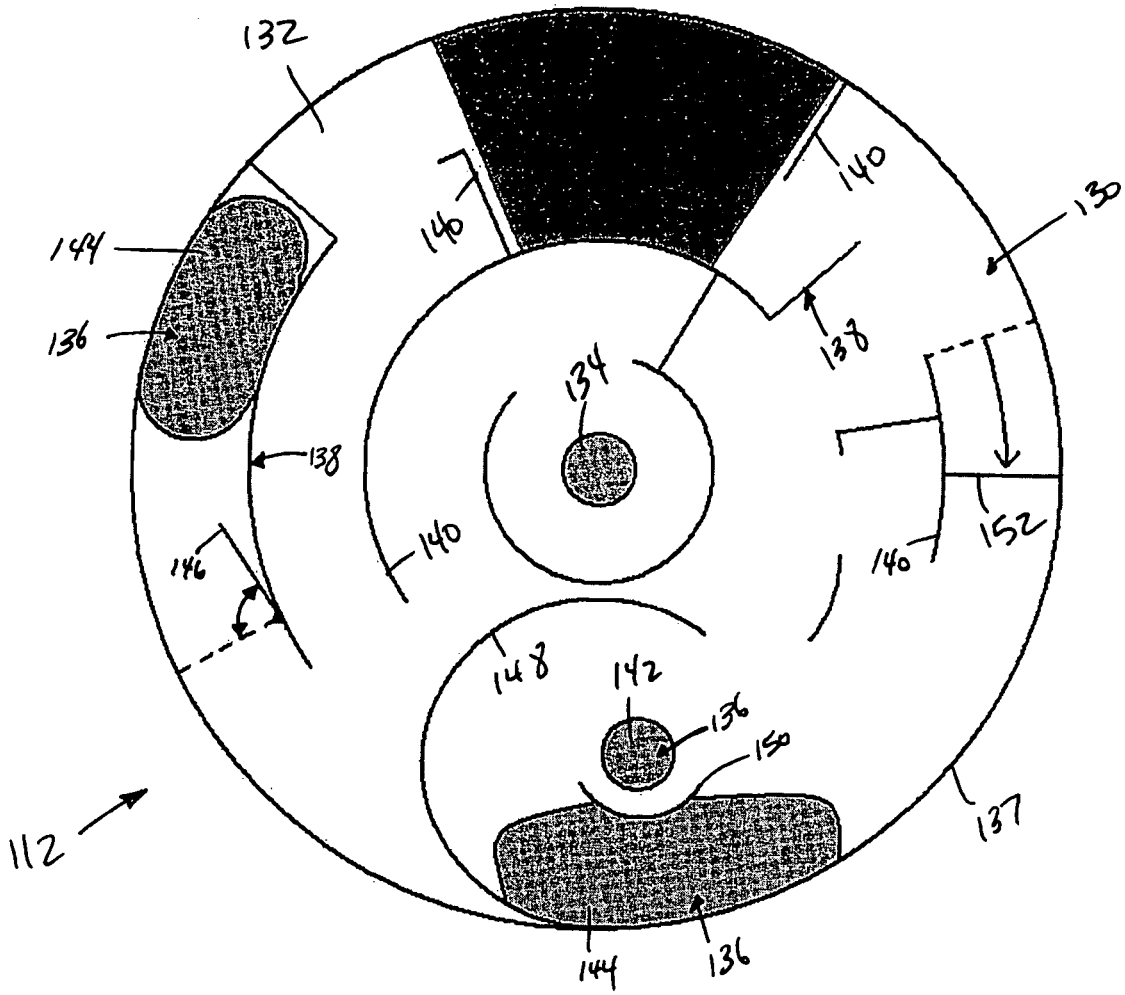
FIG. 5B is a front view of a third embodiment of a game of skill.

The game of skill 112 illustrated in FIG. 5 also includes at least one task to be completed by the consumer in order to successfully complete the game of skill 112. The first task to be completed by the consumer is to navigate a game piece (not shown) through a series of walls 140 that extend radially inward from the side wall 137 as well as radially outward from a wall 140 having a shape that is significantly concentric with respect to the side wall 137. In an alternative embodiment, a portion of the playing field 130 is covered, or hidden, by a screen 154 such that the task of navigating a game piece through the series of walls 140 is more difficult, as shown in FIG. 5B. In a further alternative embodiment, a portion of the playing field 130 is covered, or hidden, by a screen 154, as shown in FIG. 5B, and also includes a losing aperture (not shown) located below the hidden portion of the playing field 130.

Another task to be completed by the consumer, as shown in FIG. 5A, includes an obstacle formed as a loop 148. The loop 148 extends between the floor 132 and the cover that is disposed adjacent to the top edge of the side wall 137. The loop 148 is a curved member that extends inwardly from the side wall 137. A catch 150 is an opposing curved member that is located within the curvature of the loop 148. The winning aperture 142 is located within the curvature of the catch 150 such that when a game piece is received in the inner curved portion of the catch 150, the game piece exits the playing field 130 and the consumer has successfully completed, or won, the game of skill 112. The loop 148 is configured to guide the game piece within the playing field 130 in a substantially curved manner, wherein the objective of the task is to cause the game piece to land in the inner curvature of the corresponding catch 150. A losing exit aperture 144 is located radially outward from the catch 150 such that failure of the consumer to land the game piece on the catch 150 results in an unsuccessful completion, or loss, of the game of skill 112. The consumer must gauge the speed of the game piece around playing field 130 such that the game piece passes over the losing exit aperture 144 located adjacent to the catch 150 and continues in a rolling manner adjacent to the loop 148 with enough speed to be received within the catch 150 without over- or under-shooting the catch 150.

The level of difficulty of the game of skill 12, 112 can be modifiable. The level of difficulty can be modified by the consumer or the person maintaining the bulk vending machine 10 to which the game of skill 12, 112 is connected. In the game of skill 12, 112, a plurality of exit apertures 36, 136 can be formed through the floor 32, 132 of the playing field 30, 130 such that the passage of the game piece within the playing field through an exit aperture 36, 136 results in unsuccessful completion, or loss, of the game of skill 12, 112. The level of difficulty can be decreased by allowing the playing field 30, 130 to be modified such that these exit apertures 36, 136 resulting in a loss are covered. Additionally, the size or shape of the exit apertures 36, 136 can be increased or decreased, thereby modifying the level of difficulty of the game of skill 12, 112. Further, in the second embodiment of the game of skill 112 illustrated in FIGS. 5A-5B, the size of the catch 150 can be increased or decreased, thereby allowing the level of difficulty to be modified by providing greater or lesser surface area on which to receive the game piece within the playing field 130. In addition, the starting wall 152, as shown in FIG. 5, can be adjustable such that the game piece has a greater or lesser distance to travel before entering the loop 148. The location of the starting wall 152 relative to the loop 148 can increase or decrease the level of difficulty by increasing or decreasing the amount of distance for which the user can adjust the speed of the game piece in order for the game piece to have the proper speed to land in the catch 150. It should be understood by one skilled in the art that other modifications sufficient to increase or decrease the level of difficulty of the game of skill 12, 112 can be used.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

The invention claimed is:

1. A bulk vending machine comprising:

(a) a base having a coin mechanism and a chute door operatively connected thereto;

(b) a hopper operatively connected to said coin mechanism and said chute door; and (c) a game of skill operatively connected to a frame that is attached to at least one of said hopper or said base, wherein said game of skill is movable relative to said frame.

2. The bulk vending machine of claim 1, wherein said game of skill is rotatable relative to said frame.

3. The bulk vending machine of claim 1, wherein said game of skill is operatively connected to said frame by way of a connecting mechanism.

4. The bulk vending machine of claim 3, wherein said connecting mechanism is a rotatable bearing.

5. The bulk vending machine of claim 3, wherein said frame includes a panel member and said connecting mechanism is attached to said panel member.

6. The bulk vending machine of claim 1, wherein said game of skill includes a playing field defined by a floor, a cover, and at least one side wall.

7. The bulk vending machine of claim 1, wherein said game of skill is translatable relative to said frame.

8. A game of skill integrated with a bulk vending machine, said game of skill comprising:

(a) a game piece maneuverable within a playing field, wherein said playing field includes at least one obstacle, at least one entrance aperture, and at least one exit aperture; and (b) a connecting mechanism operatively connecting said playing field to said bulk vending machine, wherein said playing field is movable relative to said bulk vending machine.

9. The game of skill integrated with a bulk vending machine of claim 8, wherein said connecting mechanism is a rotatable bearing.

10. The game of skill integrated with a bulk vending machine of claim 8, wherein said playing field includes a floor, a cover, and a side wall extending between said floor and said cover.

11. The game of skill integrated with a bulk vending machine of claim 10, wherein said game piece is insertable into said playing field through said at least one entrance aperture, and said game piece is exitable from said playing field through said at least one exit aperture.

12. The game of skill integrated with a bulk vending machine of claim 11, wherein said at least one entrance aperture is spaced apart from said at least one exit aperture.

13. The game of skill integrated with a bulk vending machine of claim 8, wherein said at least one obstacle includes spaced-apart walls disposed within said playing field.

14. The game of skill integrated with a bulk vending machine of claim 13, wherein said walls are arranged to form a maze.

15. The game of skill integrated with a bulk vending machine of claim 13, wherein said game of skill has a level of difficulty, and said level of difficulty is modifiable by adjusting the location of at least one of said walls within said playing field.

16. The game of skill integrated with a bulk vending machine of claim 13, wherein one of said at least one obstacle is formed as a loop and another one of said at least one obstacle is formed as a catch.

17. The game of skill integrated with a bulk vending machine of claim 8 having at least two exit apertures, wherein one of said at least one exit aperture is a winning exit aperture and one of said at least one exit aperture is a losing exit aperture.

18. The game of skill integrated with a bulk vending machine of claim 17, wherein manipulation of said game piece such that said game piece exits said playing field through said winning exit aperture results in said game piece being dispensed to a consumer.

19. A bulk vending machine comprising:

(a) a base having a coin mechanism and a chute door operatively connected thereto;

(b) a hopper operatively connected to said coin mechanism and said chute door; and (c) a game of skill operatively connected to a frame that is attached to at least one of said hopper or said base, wherein said game of skill is operatively connected to said frame by way of a connecting mechanism that comprises a rotatable bearing.

20. The bulk vending machine of claim 19, wherein said frame includes a panel member and said connecting mechanism is attached to said panel member.

21. The bulk vending machine of claim 19, wherein said game of skill includes a playing field defined by a floor, a cover, and at least one side wall.

* * * * *